US009768524B2

(12) United States Patent
Seipel et al.

(10) Patent No.: US 9,768,524 B2
(45) Date of Patent: Sep. 19, 2017

(54) ELECTRICAL CRIMP CONTACT

(71) Applicant: TE Connectivity Germany GmbH, Bensheim (DE)

(72) Inventors: Volker Seipel, Bensheim (DE); Uwe Bluemmel, Hemsbach (DE); Wolfgang Mueller, Darmstadt (DE); Guido Van De Burgt, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/846,026

(22) Filed: Sep. 4, 2015

(65) Prior Publication Data

US 2015/0380834 A1 Dec. 31, 2015

Related U.S. Application Data

(63) Continuation of application No. PCT/EP2014/054299, filed on Mar. 6, 2014.

(30) Foreign Application Priority Data

Mar. 6, 2013 (DE) ..... 10 2013 203 796

(51) Int. Cl.
*H01R 4/18* (2006.01)

(52) U.S. Cl.
CPC ..... *H01R 4/182* (2013.01); *H01R 4/188* (2013.01); *H01R 4/185* (2013.01); *H01R 2201/26* (2013.01)

(58) Field of Classification Search
CPC .... H01R 4/185; H01R 4/182; H01R 2201/26; H01R 4/188
USPC ..... 439/877, 442, 424, 882; 174/84 C
See application file for complete search history.

(56) References Cited

U.S. PATENT DOCUMENTS

| | | | | |
|---|---|---|---|---|
| 2,854,648 | A * | 9/1958 | Berg | H01R 4/188 439/867 |
| 3,989,339 | A | 11/1976 | Haitmanek | |
| 4,142,771 | A * | 3/1979 | Barnes | H01R 4/184 174/84 C |
| 5,658,163 | A * | 8/1997 | DeRoss | H01R 4/2495 174/84 C |
| 8,177,590 | B2 * | 5/2012 | Tanaka | H01R 4/185 439/877 |

(Continued)

FOREIGN PATENT DOCUMENTS

| | | | |
|---|---|---|---|
| CN | 101814662 | A | 8/2010 |
| EP | 0263325 | A2 | 4/1988 |
| EP | 0657962 | A2 | 6/1995 |

(Continued)

OTHER PUBLICATIONS

International Search Report, International Application No. PCT/EP2014/054299, dated May 14, 2014, 4 pages.

(Continued)

*Primary Examiner* — Edwin A. Leon
(74) *Attorney, Agent, or Firm* — Barley Snyder

(57) ABSTRACT

An electrical crimp contact that crimps onto an electrical cable has a conductor crimp region for an electrical connection of a conductor of the cable, the conductor crimp region having a fixing device for fixing the conductor. In a blank of the contact, the fixing device of the conductor crimp region extends at an oblique angle with respect to a longitudinal axis of the contact.

21 Claims, 2 Drawing Sheets

(56) References Cited

U.S. PATENT DOCUMENTS 8,303,354 B2 * 11/2012 Ootsuka ..... H01R 4/185
439/877
9,039,467 B2 5/2015 Seipel et al.

FOREIGN PATENT DOCUMENTS

JP 2009245697 A 10/2009
JP 2010010000 A 1/2010

OTHER PUBLICATIONS

Abstract of JP 2009245697, 2 pages, dated Oct. 22, 2009.
Abstract of EP 0263325, 2 pages, dated Apr. 13, 1988.
Abstract of JP 2010010000, 2 pages, dated Jan. 14, 2010.
Chinese First Office Action and English translation, dated Sep. 26, 2016, 16 pages.
Abstract of CN101814662, dated Aug. 25, 2010, 2 pages.

* cited by examiner

ELECTRICAL CRIMP CONTACT

CROSS-REFERENCE TO RELATED APPLICATIONS

This application is a continuation of PCT International Application No. PCT/EP2014/054299 filed Mar. 6, 2014, which claims priority under 35 U.S.C. §119 to German Patent Application No.: 10 2013 203 796.1, filed Mar. 6, 2013.

FIELD OF THE INVENTION

The invention relates to an electrical crimp contact, in particular for an aluminium cable, such as a tab contact, splice contact or socket contact. The invention further relates to a preassembled electrical cable, in particular an aluminium cable.

BACKGROUND

In electronics and electrical engineering, there are known a large number of electrical connections, in particular plug type connections, which serve to transmit electrical currents, electrical voltages and/or electrical signals with the greatest possible range of currents, voltages, frequencies and/or data rates. In particular in the automotive sector, such connections must temporarily, where applicable after a comparatively long period of time, or permanently ensure correct transmission of electrical power, electrical signals and/or data under thermally loaded, dirty, damp and/or chemically aggressive conditions. Therefore, a large number of specially constructed electrical contacts, in particular crimp contacts, which act as plug type contacts in plug type connectors are known.

Such crimp contacts which are constructed, for example, as tab, splice or socket contacts or installations, may be crimped on an electrical cable, a cable harness and/or on/in an electrical conductor. They may also be securely produced on an electrical installation of an electrical, electronic or electro-optical apparatus. If the contact is located on a cable or a cable harness, it is often referred to as a (floating) plug type or socket contact, or a connector or a coupling; if the contact is located on/in an electrical, electronic or electro-optical device, it is usually referred to as a flush type contact or installation, or a flush type socket.

In addition to a permanent electrical connection, a permanent mechanical connection must also be produced between the cable and a conductor crimp region of the crimp contact by means of a contact. For an electromechanical connection, the crimp contact has a conductor crimp region and in most cases an insulation crimp region for the cable. Miniaturisation and cost savings are forcing manufacturers towards smaller and thinner contacts.

SUMMARY

An electrical crimp contact that crimps onto an electrical cable is disclosed. The contact has a conductor crimp region for an electrical connection of a conductor of the cable, the conductor crimp region having a fixing device for fixing the conductor. In a blank of the contact, the fixing device of the conductor crimp region extends at an oblique angle with respect to a longitudinal axis of the contact.

BRIEF DESCRIPTION OF THE DRAWINGS

The invention will now be described by way of example with reference to the accompanying figures of which.

DETAILED DESCRIPTION OF THE EMBODIMENTS

The invention is explained in greater detail below with reference to two embodiments of an electrical contact or electrical contact installation. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
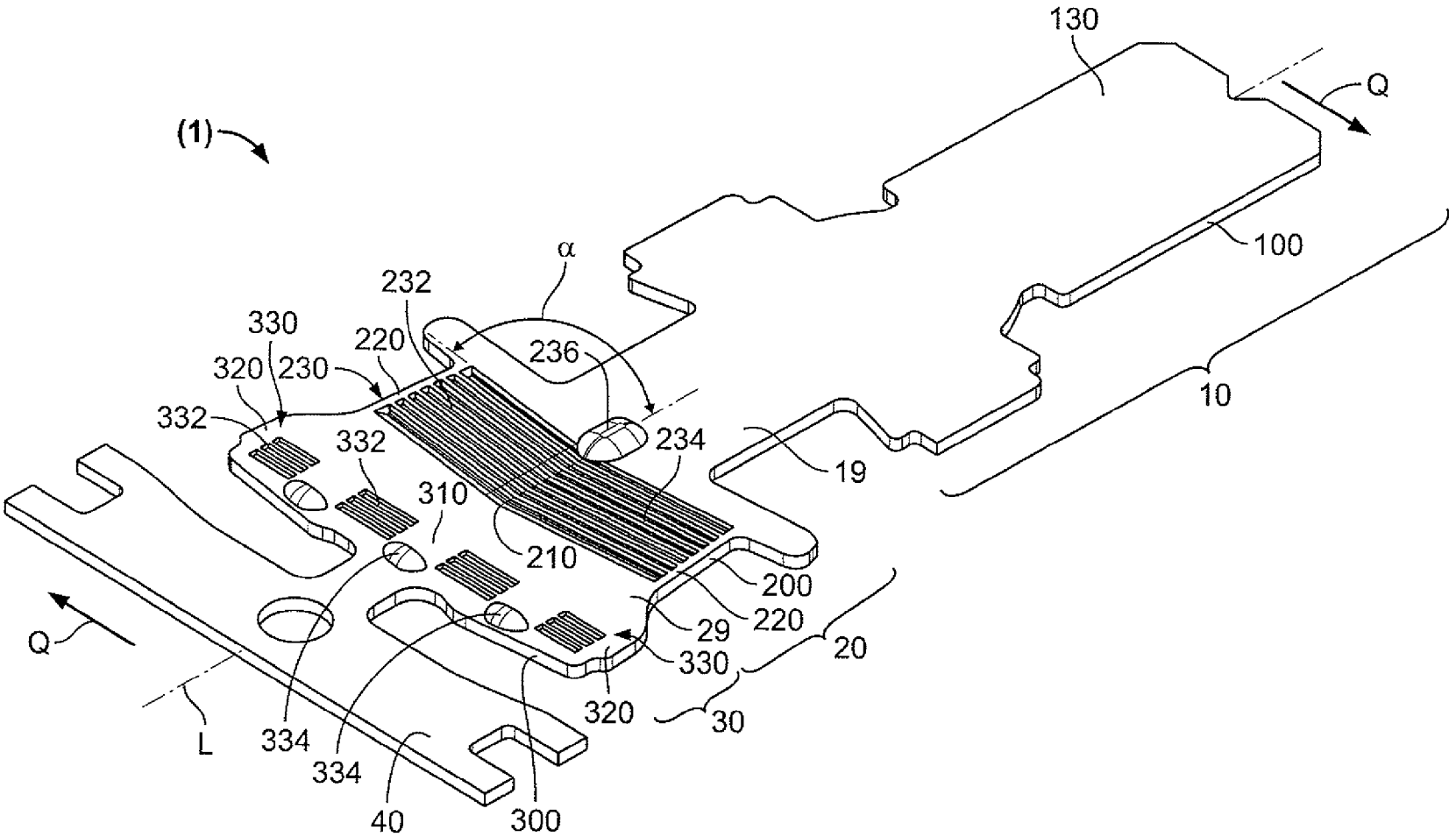
FIG. 1 is a perspective view of a punched or shaped/punched blank of a crimp contact having a fixing device in a conductor crimp region according to an embodiment of the current invention.
Figure 2:
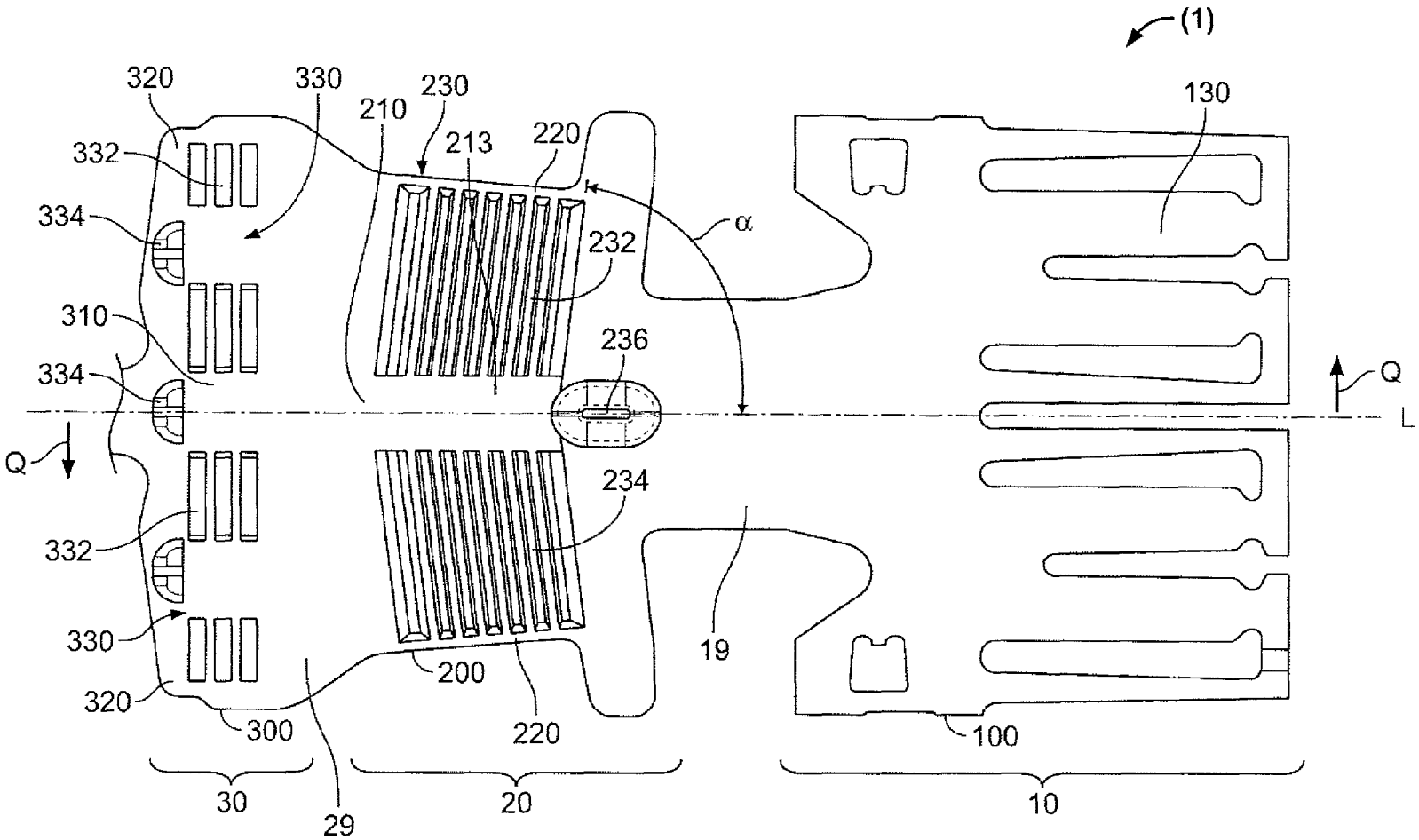
FIG. 2 is a plan view of a punched or shaped/punched blank of a crimp contact of the current invention depicting a second embodiment of a fixing device in a conductor crimp region.

FIG. 1 and FIG. 2 each show a punched or shaped/punched blank of the contact 1 according to embodiments of the invention; the contact 1 is illustrated in an open state, before bending or shaping to form the crimpable contact 1. Instead of a punched or shaped/punched blank, any other blank of the contact 1 can also be used. The contact 1 may be constructed as a tab, a socket, a pin or stud contact, a flat connector or an insertion sleeve. It is naturally possible to use features the invention on other contacts 1 which are not mentioned here. The contact 1 is integral and cannot be readily separated or is held together in a non-positive-locking and/or positive-locking manner. The contact 1 is preferably materially integral or held together in a materially engaging manner and unable to be separated without damaging a component, or is produced in a homogeneous manner in the sense of being from a single piece.

The contact 1 has an electrical and mechanical contact region 10 for an electrical counter-contact. This contact region 10 merges via a transition region 19 into the conductor crimp region 20. It is only necessary for the contact 1 to have a conductor crimp region 20 according to the invention. Mechanical fixing of an insulation of an electrical cable can also be carried out without crimping, for example, by means of adhesive bonding, etc. The cable which can be provided on the contact 1 may, for example, be an electrical line, a wire or a component of a cable harness, a cable bundle, etc. The conductor of the cable may be a stranded, a core or a single wire. The cable which is provided with the contact 1 according to the invention is referred to here as a preassembled or prefabricated cable.

The conductor crimp region 20 in turn merges via a transition region 29 into a mechanical insulation crimp region 30 for the electrical insulation and optionally the conductor (by means of insulation) of the cable. The blank and/or the shaped contact 1, may be taken up with a series of others on a reel or band roller 40. Before, during or after a crimping operation of the contact 1, the contact 1 can be separated from the reel 40. After a crimping operation, a respective crimp region 20, 30 is also referred to as a crimp sleeve 20, 30.

When the contact 1 is shaped to form a crimpable contact 1, a material layer 100 of the contact region 10 is bent to form a tab 130, a contact tongue 130, a contact cage or contact casing, etc. In this instance, in particular when a tab 130 or contact tongue 130 is used, there may be provided on the contact 1 a cage or casing which is constructed as a separate component. It can be engaged, for example, in a housing, and/or can guide a contact tongue 130, limit it in terms of the movement freedom thereof, or protect it from overextension during mating.

Furthermore, when the punched blank is shaped to form the contact 1, a material layer 200 of the conductor crimp region 20 is bent to form a substantially u-shaped or v-shaped connection base 210, and to form at least one, or two crimp flanks 220, tabs 220 or wings 220. When the line is crimped to the conductor crimp region 20, the crimp flanks 220 are bent over and a conductor crimp is formed by frictional or non-positive-locking engagement. An inner side of the conductor crimp region 20 has a fixing device 230 for the conductor. This fixing device 230 preferably comprises sharp-edged grooves, which penetrate an oxide layer of the conductor. If conductor comprises aluminium, crimping ensures partial cold welding and consequently establishes a good electrical connection.

The contact 1 has in its longitudinal direction L towards the rear, in a direction away from the contact region 10, an insulation crimp region 30 which accordingly adjoins the conductor crimp region 20. A simple cross-sectional shape of the insulation crimp region 30, before a crimping operation, is substantially u-shaped or v-shaped in the same manner as the conductor crimp region 20. In the form of the blank which can be seen in FIGS. 1 and 2, substantially all the material layers 100, 200, 300 of the contact 1 are in mutual alignment and are substantially planar.

When the conductor crimp region 20 is shaped and/or crimped, there is a partial displacement of the crimp flanks 220 and consequently also of the fixing device 230 with respect to the connection base 210 along the longitudinal axis L, in the direction of the insulation crimp region 30. This displacement is greatest on/in the lateral transverse ends of the crimp flanks 220. Consequently, with short "crimps", a number or portions of operational grooves of the serration is reduced. The fixing device 230 is therefore constructed and in particular provided or configured in a state positioned in an oblique manner on/in the conductor crimp region 20 in such a manner that a longitudinal direction offset of the fixing device 230 can be compensated for at the other side of the connection base 210.

FIG. 1 shows such a compensating inclined position of the fixing device 230 in the blank before it is shaped to form the crimpable contact 1. The fixing device 230 according to the invention has for this purpose two fixing zones 232, 234 which meet each other on the connection base 210. The fixing device or the fixing zone comprises at least one mesoscopic or macroscopic recess and/or at least one mesoscopic or macroscopic projection. A single fixing zone 232, 234 is preferably constructed as a 3D structure zone having at least one groove and/or rib, a grooved structure, a ripple structure, a corrugated structure or a serration, that is to say, a "tooth-like arrangement" having wide teeth which extend substantially in the transverse direction Q. In this instance, the two fixing zones 232, 234 are constructed in a similar manner and as mirror images of each other around the longitudinal axis L. A single fixing zone 232, 234 can also be used as a fixing device 230.

Each fixing zone 232, 234 is provided at an angle $\alpha$ or internal angle $\alpha$ in an oblique manner with respect to the longitudinal axis L. In this instance, the angle $\alpha$ is an angle between a flank of the respective fixing zone 232, 234 and the longitudinal axis L. The angle $\alpha$ is smaller, approximately 0.5-20° smaller, than a right angle. The two fixing zones 232, 234 form an arrowhead-like formation between them, a "head" of this arrow pointing away from the contact region 10 towards the insulation crimp region 30. According to the invention, provision is made for a displacement of the fixing device 230 during a shaping or crimping operation in a layout of the punched blank.

The path of a flank of the fixing zone 232, 234 may be a 3D structure zone of any form, as long as it is arranged in an oblique or angled manner with respect to the longitudinal axis of the contact and/or is interrupted or bridged by the web of the conductor crimp region in the transverse direction. The respective flank of the 3D structure zone may extend outside these peripheral conditions in particular in a linear manner. However, it is also possible to use a curved, or a partially linear and a partially curved, path of a respective flank of the 3D structure zone. Interruptions of the flanks can also be used. The flanks of a 3D structure zone may optionally be constructed to be mutually partially parallel and/or optionally partially convergent and/or divergent.

During the shaping operation of the blank to form a crimpable contact 1 and/or during crimping of the crimpable contact 1, this angle $\alpha$ or internal angle $\alpha$ increases preferably to approximately 90°. It is thereby possible, even with smaller and thinner contacts 1, to obtain a small crimp length, which can be seen in a shorter and also materially-reduced contact 1. Such a contact 1 is particularly suitable for aluminium cables; but copper cables or cables having other electrical conductors can naturally also be used.

A fixing device 230 which is continuous in a transverse direction Q, due to a shaping stamping method is weakened. For example, the serration in the material layer 200 of the blank in certain regions of the fixing device 230 is reduced to a comparatively high degree. Consequently, the contact 1 is more unstable in such a region than at the other side thereof. A second embodiment of the invention depicted in FIG. 2 reduces this weakening via an interruption of the fixing device 230, in particular in the region of the connection base 210. In region 210 of FIG. 2, no fixing device 230 or no fixing zone 232, 234 is provided. In this embodiment, the original material layer (100), 200, (300) of the contact 1 is maintained in the longitudinal direction L.

In other embodiments of the invention, in the blank, in addition or as an alternative to the oblique positioning of the fixing device 230, there is provided a web 213 in the connection base 210, which reinforces the contact 1. In this instance, the web 213 may extend between the fixing zones 232, 234 and preferably from the transition region 19 over the conductor crimp region 20 as far as a location in/on the transition region 29. The web 213 comprises in particular a complete thickness of an unmodified material layer 200 of the contact 1. A comparatively thin contact 1 is thereby on the whole more stable.

A stability of the contact 1 may further be improved by means of a bead 236 or reinforcement stamping 236 on/in the connection base 210 and/or the transition region 19. The bead 236 may in this instance be provided on or optionally partially in the web 213. In this instance, the bead 236 is preferably provided between the conductor crimp region 20 and the transition region 19 or so as to extend into one and/or both regions 19, 20. The web 213 according to the embodiment or the interruption according to the embodiment of the fixing device 230, in particular in the region of the connection base 210, can also be used on a fixing device of other contacts.

Furthermore, the contact 1 may have an insulation crimp region 30 which is constructed in a particular manner and which is functional for a mechanical clamping of the insulation of the cable. The insulation crimp region 30 comprises a crimp base 310, optionally one or both crimp flanks 320, and an insulation fixing device 330 for securing the insulation in such a manner that the insulation of the cable in addition to the mechanical clamping can be mechanically secured by means of the insulation crimp region 30. The insulation fixing device 330 comprises at least one mesoscopic or macroscopic recess and/or at least one mesoscopic or macroscopic projection. When an insulation crimp is configured between the insulation crimp region 30 and the insulation of the cable, the projection preferably engages in the insulation and/or the insulation in the recess.

The material layer 300 of the insulation crimp region 30 has as an insulation fixing device 330 having at least one insulation fixing zone 332, 334 with different material thicknesses. The material layer 300 of the insulation fixing device 330 in this instance has a simple cross-sectional shape of the material layer 300, and a deviation from this cross-sectional shape. The insulation crimp region 30 may have in the transverse direction Q and/or longitudinal direction L of the contact 1 a plurality of mutually spaced-apart insulation fixing zones 332, 332; 332, 334; 334, 334.

In embodiments of the invention, the insulation crimp region 30 has mutually spaced-apart in a transverse direction Q, a plurality of similar insulation fixing zones 332; 334 and mutually spaced-apart in a longitudinal direction L, a plurality of different insulation fixing zones 332, 334. A first insulation fixing zone 332 is a 3D structure zone of the first type 332 with at least one rib or groove, groove structure, ripple structure, corrugated structure, or serration. A second insulation fixing zone 334 is a 3D structure zone of the second type 334 with at least one cam, claw, hook, knob-like structure, needle structure, or hook structure.

In an embodiment of the invention, the insulation crimp region 30 of the contact 1 in the transverse direction Q has a plurality of 3D structure zones of the first type 332 and a plurality of 3D structure zones of the second type 334. In this instance, the 3D structure zones of the first type 332 may alternate with the 3D structure zones of the second type 334 in the transverse direction Q, and the 3D structure zones of the first type 332 may be adjacent to each other, without overlapping, with respect to the 3D structure zones of the second type 334 in the longitudinal direction L.

Two insulation fixing zones 332, 332; 332, 334; 334, 334 of the insulation fixing device 300 are according to the embodiments provided in a state separated from each other in a distinct manner, that is to say, delimited with respect to each other or excluded from each other. Two insulation fixing zones 332, 332; 332, 334; 334, 334 preferably do not merge into each other. However, this is possible in border regions. In particular at least two insulation fixing zones 332, 332; 332, 334; 334, 334 are provided adjacent to each other, for example directly adjacent to each other. The insulation fixing zones 332, 332; 332, 334; 334, 334 are provided in the transverse direction Q of the insulation crimp region 30 optionally alternating in a linear or zig-zag manner in such a manner that, optionally with the exception of transverse ends or transverse end portions of the crimp flanks 320, they bridge substantially the entire transverse direction Q of the insulation crimp region 30. The insulation fixing zones 332, 332; 332, 334; 334, 334 may be constructed in such a manner that a fluid-tight connection can be produced between the insulation crimp region 30 and the insulation of the cable. A gap in the transverse direction Q between two directly adjacent insulation fixing zones of the first type 332 is in this instance are substantially as large as or slightly larger or smaller than an insulation fixing zone of the second type 334, and vice versa.

In principle, a possible distribution of the insulation fixing zones 332, 332; 332, 334; 334, 334 on/in the insulation crimp region 30 may be of any type. However, they may be selected and/or arranged so as to be distributed in such a manner that, when the contact 1 is bent and/or the cable is angled on the insulation crimp region 30, the insulation of the cable does not slide out of the insulation crimp, that is to say, does not slide out of the insulation crimp region 30 of the contact 1. In this instance, a combination or a plurality of combinations of the two insulation fixing zones 332, 334 may be provided, the insulation fixing zone of the first type 332 deforming the insulation of the cable only in a resilient manner and the insulation fixing zone of the second type 334 deforming the insulation of the cable in a resilient manner and optionally plastically, for example, by means of penetration or piercing.

A single assembled crimp flank 220, 29, 320 of the contact 1, that is to say, the assembled crimp flank 220, 29, 320 of a longitudinal side of the contact 1, has in this embodiment a single crimp flank or wing 220 of the conductor crimp region 20 and a single crimp flank or wing 320 of the insulation crimp region 30 and the transition region 29 which is located therebetween. An outer edge of the assembled crimp flank 220, 29, 320 is in this embodiment provided spaced-apart from the longitudinal axis L. That is to say, the transition region 29 substantially completely fills a gap between the hypothetical crimp wings or flanks 220, 320.

What is claimed is:

1. An electrical crimp contact, comprising:

a conductor crimp region having a pair of crimp flanks, each crimp flank disposed on an opposite side of a connection base;

a conductor fixing device extending at an oblique angle from a longitudinal axis of the crimp contact and disposed continuously in the pair of crimp flanks and the connection base in a transverse direction of the crimp contact; and an insulation crimp region having an insulation fixing device including a first insulation fixing zone formed as at least one recess and a second insulation fixing zone formed as at least one projection.

2. The electrical crimp contact of claim 1, wherein the conductor fixing device is constructed in an arrowhead or v-shape in the conductor crimp region, in such a manner that the tip of the arrowhead or v-shape points in the direction of the insulation crimp region.

3. The electrical crimp contact of claim 1, wherein the oblique angle of the conductor fixing device with respect to the longitudinal axis of the contact is greater than 0° and less than 90°.

4. The electrical crimp contact of claim 3, wherein the oblique angle of the conductor fixing device is greater than or equal to 45° and less than or equal to 89°.

5. The electrical crimp contact of claim 4, wherein the oblique angle of the conductor fixing device is greater than or equal to 70° and less than or equal to 89°.

6. The electrical crimp contact of claim 1, wherein the conductor fixing device comprises a first conductor fixing zone and a second conductor fixing zone, one or both conductor fixing zones extending at an oblique angle with respect to the longitudinal axis.

7. The electrical crimp contact of claim 6, wherein the first conductor fixing zone is formed in a mirror image of the second conductor fixing zone along the longitudinal axis of the contact.

8. The electrical crimp contact of claim 1, wherein the conductor fixing device is a 3D structure having at least one of a rib, a groove, a groove structure, a ripple structure, a corrugated structure, and a serration.

9. The electrical crimp contact of claim 1, wherein the insulation crimp region mechanically clamps an insulation of a cable and the insulation fixing device additionally mechanically secures the cable.

10. The electrical crimp contact of claim 9, wherein the first insulation fixing zone has at least one of a rib, groove, groove structure, ripple structure, corrugated structure, and serration, and the second insulation fixing zone has at least one of a cam, claw, hook, knob-like structure, needle structure, and hook structure.

11. The electrical crimp contact of claim 1, wherein the insulation fixing zones are separated distinctly from each other in the insulation crimp region, the first insulation fixing zone located adjacent to the second insulation fixing zone.

12. The electrical crimp contact of claim 1, further comprising a reinforcement stamping at least partially overlapping the conductor crimp region.

13. A preassembled electrical cable, comprising:

an electrical crimp contact crimped to an electrical cable;

the electrical crimp contact having a conductor crimp region having a pair of crimp flanks, each crimp flank disposed on an opposite side of a connection base, a conductor fixing device extending at an oblique angle from a longitudinal axis of the crimp contact and disposed continuously in the pair of crimp flanks and the connection base in a transverse direction of the crimp contact, and an insulation crimp region having an insulation fixing device including a first insulation fixing zone formed as at least one recess and a second insulation fixing zone formed as at least one projection.

14. A blank of an electrical crimp contact, comprising:

a conductor crimp region having a crimp flank;

a conductor fixing device disposed in the crimp flank and extending at an oblique angle from a longitudinal axis of the blank in a plane of the crimp flank, the oblique angle configured such that the oblique angle becomes perpendicular to the longitudinal axis of the blank in the plane of the crimp flank after crimping; and an insulation crimp region having an insulation fixing device including a first insulation fixing zone formed as at least one recess and a second insulation fixing zone formed as at least one projection.

15. The blank of claim 14, wherein the conductor fixing device is interrupted by a web of the conductor crimp region in a transverse direction of the contact.

16. The blank of claim 15, wherein the conductor fixing device comprises a first conductor fixing zone and a second conductor fixing zone, one or both conductor fixing zones extending at an oblique angle with respect to the longitudinal axis.

17. The blank of claim 16, wherein the first conductor fixing zone is formed in a mirror image of the second conductor fixing zone along the longitudinal axis of the contact.

18. The blank of claim 17, wherein the web of the conductor crimp region is provided in the transverse direction between the first conductor fixing zone and the second conductor fixing zone, the web constituting a complete thickness of a material layer of the conductor crimp region.

19. The blank of claim 14, wherein the oblique angle of the conductor fixing device is greater than or equal to 45° and less than or equal to 89°.

20. The electrical crimp contact of claim 11, wherein the first insulation fixing zone has a plurality of recesses disposed along the transverse direction of the crimp contact and the second insulation fixing zone has a plurality of projections disposed along the transverse direction of the crimp contact.

21. The electrical crimp contact of claim 20, wherein the plurality of recesses of the first insulation zone are mirrored about the longitudinal axis of the crimp contact and the plurality of projections are mirrored about the longitudinal axis of the crimp contact.

* * * * *